United States Patent [19]

Wofford et al.

[11] Patent Number: 5,066,165

[45] Date of Patent: Nov. 19, 1991

[54] MODULAR AND COMPONENTIAL TRENCH DRAIN SYSTEM

[76] Inventors: Ray F. Wofford, 190 Broadmeadow Cove, Roswell, Ga. 30075; George S. Potter, 7419 Nicole Cir., Charlotte, N.C. 28226

[21] Appl. No.: 566,975

[22] Filed: Aug. 13, 1990

[51] Int. Cl.[5] ..... E02B 5/00

[52] U.S. Cl. ..... 405/119; 404/4; 405/118

[58] Field of Search ..... 405/118, 119, 120, 121; 210/163, 164; 404/2–4

[56] References Cited

U.S. PATENT DOCUMENTS

| | | | |
|---|---|---|---|
| 3,225,545 | 12/1965 | Flegel | 404/2 X |
| 4,472,078 | 9/1984 | Karbstein | 405/119 X |
| 4,553,874 | 11/1985 | Thomann et al. | 404/4 |
| 4,640,643 | 2/1987 | Williams | 404/4 |
| 4,787,773 | 11/1988 | Kehler | 405/118 |
| 4,844,655 | 7/1989 | Aleshire | 405/118 |
| 4,993,877 | 1/1991 | Beamer | 405/282 |

*Primary Examiner*—Dennis L. Taylor

*Attorney, Agent, or Firm*—Shefte, Pinckney & Sawyer

[57] ABSTRACT

A modular trench drain system comprising generally V-shaped channels, generally L-shaped grate frames, support anchors, and a grating which are arranged so as to result in a trench drain system tailored made for an individual site.

13 Claims, 2 Drawing Sheets

MODULAR AND COMPONENTIAL TRENCH DRAIN SYSTEM

BACKGROUND OF THE INVENTION

1. Field of the Invention

This invention relates generally to the field of trench drainage systems and, specifically, to a modular and componential trench drain system comprising a drain liner with slopping bottoms or level bottoms, grate frames and grates, anchors, and cross bars.

2. Prior Art

The general concept of trench drains is well known in the prior art. Trench drains generally are used in situations requiring a large or extensive drainage system, or an area subject to heavy liquid runoff, such as building perimeters, parking lots, school yards and roadways. The trench drain generally empties into a larger drainage conduit or sewer, or discharges into the earth, through bottom, side or end outlets. Additionally, trench drains usually comprise a grating flush with the surface to be drained to prevent, among other things, entry into the trench drains of undesirable objects, such as tires, feet, logs or other debris.

A typical modular trench system is disclosed in U.S. Pat. No. 3,225,545 which includes a roughly V-shaped conduit with male and female formations on opposites ends and an integral flange end for supporting a grating. The trench drain disclosed in U.S. Pat. No. 3,225,545, as well as other typical trench drain systems, has several disadvantages. For example, most trench drain components are manufactured from a rigid or stiff material such as steel or concrete. Another disadvantage is the need for some sort of gasket seal between conduit parts to avoid leakage between conduit components, or separation of the components resulting in a breach of the conduit. One additional disadvantage is the bulk and weight of the trench drain components due to the material of manufacture, usually steel or cast iron.

In order to encourage the flow of water in one direction through the trench drain system, the trench drain system should be sloped downward in the direction of desired water travel. As disclosed in the figures in U.S. Pat. No. 4,640,643, sloped conduit troughs also are known in the art. Sloped trough components having side walls of varying height are used in succession so as to keep the top of the trough level with the surface to be drained, and the bottom of the trough sloping toward the drain outlet. Although the general idea of variably sized sloped trough conduits components is advantageous, the components currently existing in the art have several disadvantages, many of which are the same disadvantages as discussed in regard to the typical modular trench drain system above.

A major disadvantage of the prior art trench drain systems in general is the lack of a modular or componential complete trench drain system which is lightweight, and therefore easily installed by workers, and is easily installed without the traditional hand forming methods utilizing lumber and nails. Furthermore, typical prior art trench drain systems are constructed of heavy materials, such as cast iron or concrete conduits, and are difficult to install, expensive to transport, and inflexible in structure.

Another disadvantage of the prior art trench drain systems is their limited hydraulic capacity. With a limited flow capacity, prior art systems cannot remove large quantities of fluid quickly, such as during torrential downpours, allowing flooding of the surface to be drained. An additional disadvantage of the prior art systems is the roughness of the interior surfaces of the system, that is the fluid carrying surfaces. Rough interior surfaces hinder the flow of water.

SUMMARY OF THE INVENTION

The trench drain system of the present invention is a modular system comprising components which are arranged so as to result in a trench drain system tailor made for the individual site. The channel component of the present invention generally is vacuum formed using a fiberglass mat impregnated with a polyester, vinyl ester, epoxy, acrylic, or other resin so as to form a generally V shaped channel. The channels are made into predetermined lengths, generally 6' lengths. The channels also may be made into almost any shape, including curves and angles. The trough of the channels has a built in slope of about one-eighth of an inch (⅛") per foot to facilitate the flow of water through the drainage system. The channels alternatively may have a flat trough which can be used either as a stand alone trench drain system where there is an existing slope, or as a method of extending the sloping system by inserting one or more non-sloping channels into the system at strategic places between the sloping channels. The opposite ends of the channels have male and female portions, respectively, such that successive channels will fit together, male end to female end, resulting in a positive seal so as to minimize disturbance to the water flow from one channel component to the adjacent channel component and leakage between channel components.

The upper edges of the modular channels extend outward in opposite directions so as to form flanges. Grate frames, which are generally L-brace type structures, are attached to the flanges on both sides of the channels. The grate frames provide a base or support for placing typical grating to cover the upper opening of the trough. The grate frames generally are provided in or specified as eighteen foot (18') lengths, and three (3) channels are attached to each pair of eighteen foot (18') grate frames. Anchors are attached to the outside edges of the grate frames which anchors will be later embedded in the concrete so as to hold the trench drain system in place. Common standard specifications require the anchors to be embedded at least about two and a half inches (2½") below the surface of the concrete.

The trench drain system of the present invention is easily installed at a site. A trench is dug in the surface to be drained and a wooden frame work is erected within the trench. The grate frames are screwed or bolted onto the channel portions and the various channel portions selected to form the drain channel are placed within the trench. Spacer bars are connected between the grate frames attached to the top edges of the channel so as to hold the channel at the proper, desired width and to act as a hanging or suspending device for the channel during the installation process. The channels are suspended from the wooden frame work within the trench and concrete is poured in the trench between the side of the trench and the channel itself. Care must be taken that the top edges of the grate frames are flushed with the surface to be drained.

When the concrete has set between the trench wall and the channel, the wooden frame work is removed and, if desired, the spacer bars also are removed. At this point one has a trench drain system comprising a concrete trench lined with the channel components. The grate frames, now flushed with the surface to be drained, are firmly attached to the concrete via the anchors mentioned earlier. The L-brace shape of the grate frame provides a suitable seat on which typical gratings can be placed.

The trench drain system of the present invention is transported easily to the installation site due to its light weight components and modular nature. As the gratings are available commercially, the grate frames generally are common "L-braces" and the anchors may be constructed from conventional rebar or steel rod, these components may be obtained close to the installation site and need not be shipped, thus saving costs. Further, as the channels are manufactured from, for example, thermoset resin impregnated fiberglass, the channels lengths are modified easily on-site by cutting to shorten the channels or by using a simple fiberglass repair kit to modify them for specific job-site characteristics.

The channels may be constructed of a lightweight material, and even be non-rigid, as the channels are not load-bearing units. The concrete poured within the trench acts as the load-bearing component, and the channels act as forms and as liners.

The disadvantages of the prior art trench drain systems discussed above are overcome by the present invention. The trench drain system disclosed herein has a greatly increased hydraulic capacity as compared to the prior art systems. The present system can carry up to five times the amount of fluid as the prior art systems. Further, the smoothness of the interior, water-carrying surfaces of the present system allows ease of flow to fluid through the system, thus increasing fluid flow. Additionally, the novel and unique shape of the channels further eases fluid flow.

Accordingly, it is an object of the present invention to provide a trench drain system in which the major components are preformed and easily transportable to the installation site.

Another object of the present invention is to provide a trench drain system which comprises lightweight materials easily installed by one or two workers.

It is yet another object of the present invention to provide a trench drain system which is modular or componential in nature.

It is a further object of the present invention to provide a trench drain system which replaces job site forming with modular, presloped, stay-in-place form segments made from lightweight, tough, corrosion resistant materials.

Another further object of the present invention is to provide a trench drain system which can be installed without the need for heavy equipment.

It is also an object of the present invention to provide a trench drain system which eliminates the need for channels constructed from concrete, steel, iron or other heavyweight materials and to use concrete or other load-bearing materials which are available locally, thus eliminating the necessity for shipping such heavyweight materials over long distances.

It is another object of the present invention to provide a trench drain system which accepts industry standard components, such as grates and frames which are available locally, thus eliminating the necessity for shipping heavy iron and steel components over long distances.

It is still another object of the present invention to provide a trench drain system which is simple in construction, efficient in operation and economic to produce.

An additional object of the present invention is to provide a trench drain system which has a greater fluid carrying capacity.

Yet another object of the present invention is to provide a trench drain system which eases fluid flow through the system.

Other objects, features and advantages of the present invention will become apparent from the following description when taken in conjunction with the accompanying drawings wherein like characters of reference designate corresponding parts throughout the several views.

DETAILED DESCRIPTION OF A PREFERRED EMBODIMENT

Figure 1:
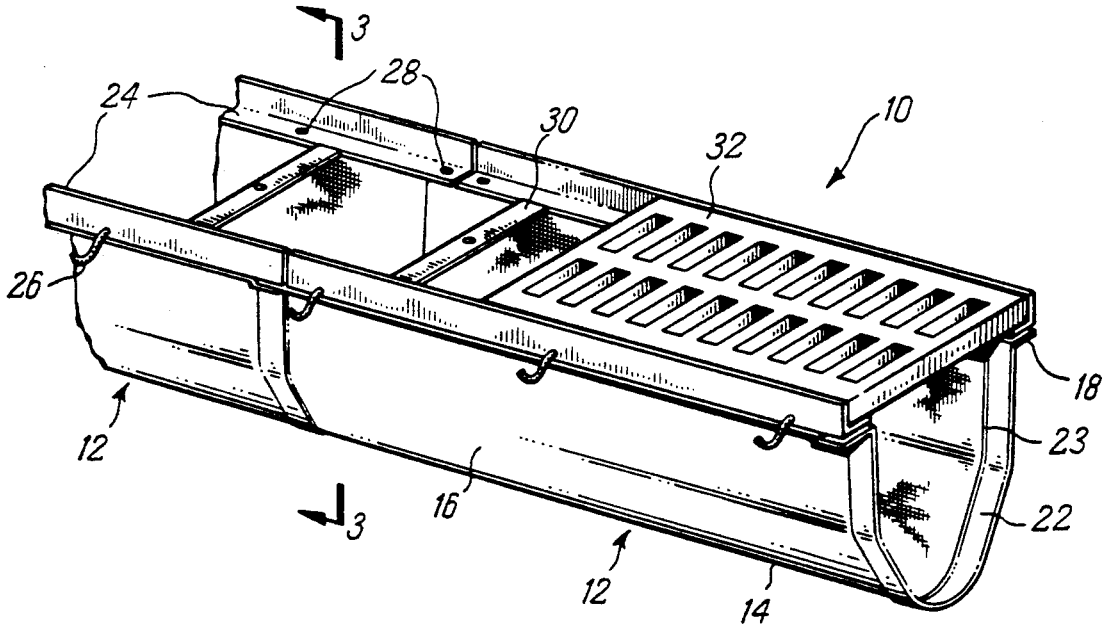
FIG. 1 is a perspective view of the present invention showing two adjacent components of the present invention.
Figure 3:
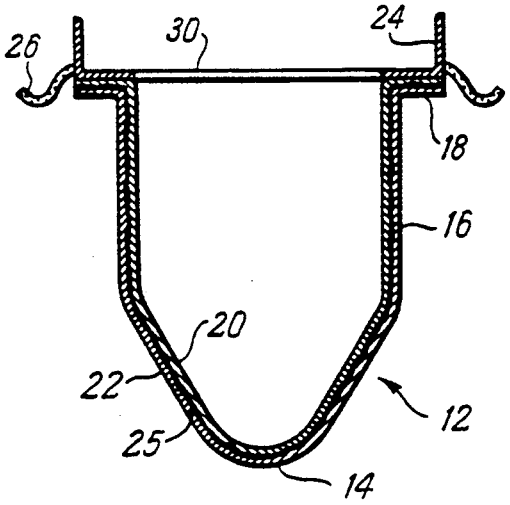
FIG. 3 is a cross section of the present invention along line 3—3 of FIG. 2.
Figure 4:
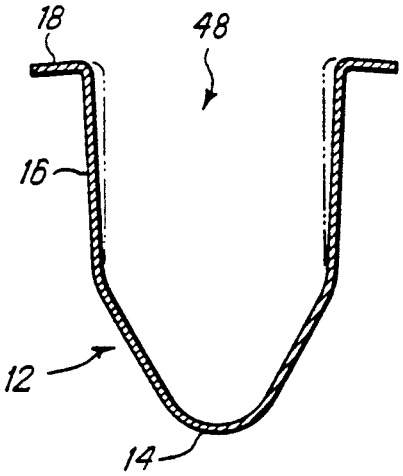
FIG. 4 is a representative section of the channel of the present invention showing in phantom lines the final configuration when the channel is installed.
Figure 5:
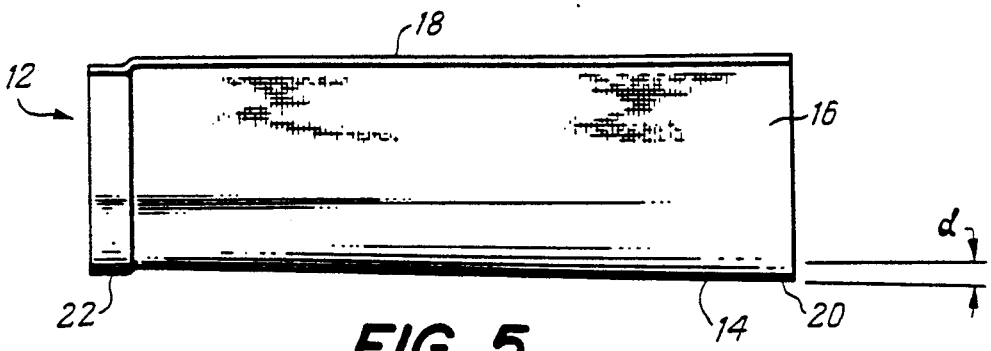
FIG. 5 is a side view of the channel of the present invention showing the sloped bottom edge of the channel.
Figure 6:
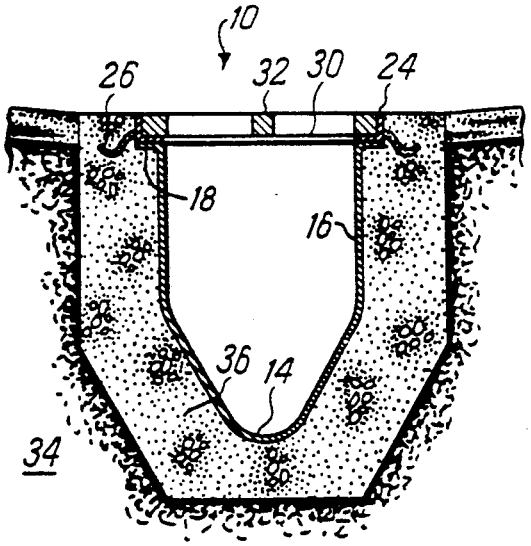
FIG. 6 is a cross section of the present invention as installed in a trench with concrete.
Figure 7:
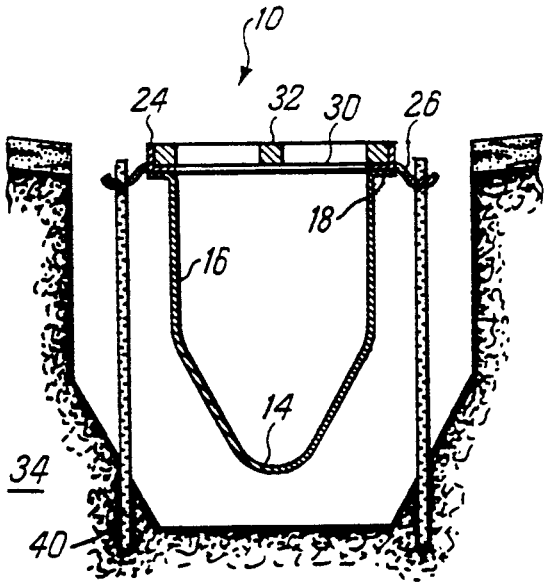
FIG. 7 is a cross section of the present invention suspended from reinforcing bars driven into bottom of the trench.

Referring now to FIG. 1, the trench drain system 10, shown in perspective view, comprises channels 12, grate frames 24, anchors 26, spacer bars 30, and grating 32. The channel 12, as shown in more detail in FIGS. 3, 4 and 5, is a generally V-shaped structure comprising a trough 14, sidewalls 16, flanges 18, a male connector 20, and a female connector 22. The channel 12 is generally vacuum formed from a fiberglass mat impregnated with a resin so as to form a lightweight component. Suitable mats include any of the various fibrous reinforced mats. Suitable resins include thermoset resins including, but not limited to, polyester, vinyl ester, epoxy, and acrylic.

Referring now to FIG. 4, the bottom of trough 14 of the channel 12 has a pair of upwardly extending diverging sidewalls 16 which, at a certain distance above the bottom of the trough 14, bend inward so as to become nearly vertical. The pair of sidewalls 16 are formed so as to be slightly divergent from each other; that is, generally in forming the channel 12, the sidewalls 16 are formed so that the sidewalls 16 diverge slightly from each other in the trough 14 to flange 18 direction. One purpose for such divergence is for ease of removal from the mold in which the channels 12 are formed.

In operation, when the trench drain system 10 is installed, the sidewalls 16 generally are forced into a vertical position generally parallel to each other. At the upper edge of each sidewall 16 is an approximately ninety degree (90°) bend outward resulting in the formation of flanges 18. Each flange 18 extends outwardly from the trough interior; therefore, flanges 18 on opposite sidewalls 16 extend generally in opposite directions from each other. Flanges 18 run the entire length of the upper edge of the sidewalls 16 along channel 12 and serve the purpose of allowing the attachment of the grate frames 24 to the channels 12, as more fully described below. The bottom wall or trough 14 and the sidewalls 16 act together to form the fluid carrying space of channel 12. Opposite the trough 14 is top opening 48 which defines the fluid entrance to the channel 12.

Referring now to FIGS. 3 and 5, it can be seen that the channels 12 comprise a male connector 20, a female connector 22, and an optional sloped trough 14, the slope represented by the angle $\alpha$. Channels 12 generally are provided in lengths of six feet (6') for convenience; however, the channels 12 can be provided in any desired length and can be supplied as various radius curves or various angled sections. The male connector 20 generally is an extension of the channel 12 with the sidewalls of the male connector being continuations of sidewalls 16 and the trough of the male connector being a continuation of trough 14 and having the same slope $\alpha$. Female connector 22 is located on the opposite end of the channel 12 from the male connector 20 and is of the same general shape as a cross section of the channel 12, but slightly wider and deeper. More specifically, the female connector 22 is an enlargement of the channel 12 and is continuous along the distal end of the channel 12 starting at one flange 18, continuing down one sidewall 16, around the trough 14, upward along the other sidewall 16 and around the other flange 18. Where the female connector 22 extends from channel 12 a ridge or abutment 23 results.

When male connector 20 from a first channel 12 is inserted into female connector 22 of a second channel 12, the outside edge of the male connector 20 abuts the ridge or abutment 23. The inside surface of the channel 12 at male connector 20 thus corresponds and cooperates with the interior surface of the second channel 12 so as to form a generally smooth, continuous interior surface along the trench drain system 10. A sealant or adhesive may be used between the outer surface of the male connector 20 and the inner surface of the female connector 22 to provide a water tight, permanent seal between successive channels 12.

Referring now to FIG. 3, the male connector 20/female connector 22 joint is shown in the more detail through a cross-section. Male connector 20 fits inside female connector 22 and the connectors 20, 22 may be sealed and/or bonded with a sealant 25. Grate frame 24 may be the grate frame attached to the channel 12 with the male connector 20 or the channel 12 with the female connector 22, as more fully described below, depending upon the type of joint between successive channels 12 desired.

The preferred joint is a lap joint. In the lap joint, the grate frame to the channel 12 having the female connector 22 extends to the outside edge of the female connector 22 while the grate frame 24 attached to the channel 12 having the male connector 20 extends to the inside edge of the male connector 20. When successive channels 12 are put together, the flange 18 of the male connector 20 fits within the space between the grate frame 24 attached to the channel 12 with the female connector 22 and the female connector 22 of that channel 12.

The channels 12 are supplied in two basic configurations. The first configuration, illustrated in FIG. 5, has a sloping trough 14. Although the slope, represented by the angle $\alpha$, may be any suitable slope, it has been found that a slope of about one-eighth of an inch ($\frac{1}{8}$") per foot of channel is preferred to facilitate the flow of water through the drainage system, the slope causing water to flow by gravity down the slope. The angle $\alpha$ is the angle which results from the desired slope per unit of channel 12 length. The second configuration, not shown, has a level trough 14; that is, the trough 14 is parallel to the upper edge of the channel, represented by the flange 18, or the slope $\alpha$ is equal to zero (0). Various alternative channel configurations such as, but not limited to, curved channels and angled channels also may be supplied.

The channels 12 also are supplied with varying height sidewalls 16 to provide both for different depth drainage systems and to allow for the use of a sloping trough 14 drainage system installed in a level surface to be drained. That is, the presence of the sloping trough 14 with a slope $\alpha$ greater than zero (0) necessitates the need for varying height sidewall 16 such that the trough 14 can slope down continuously while the upper edge of the channels 12 remains parallel to the surface to be drained. Thus, channels 12 having sidewalls 16 of varying height are used in succession so as to keep the top of the channels 12 level with the surface to be drained, and the trough 14 sloping downward toward the trench drain system 10 outlet.

Should the trench drain system 10 be of such of a length that it would become unwieldy to have a channel 12 with such large sidewall 16, due to the length of the trench drain system 10 needed for a particular site, channels 12 of the second configuration, that is with a flat trough 14 or a slope $\alpha$ equal to zero (0), may be inserted in various strategic positions between channels 12 with sloped troughs 14. In this manner, a trench drain system having an overall slope from one end (the upslope end) of the system to the other end (the downslope or outlet end) of the system can be constructed without a continuous slope and still achieve the same effect. Another use for the second configuration of channels 12 (the unsloped channels when $\alpha$ equals zero) is when the surface to be drained has a slope to it, and a slope is unnecessary in the trough 14 to ensure gravity drainage. In this manner, the channels 12 will be placed in trenches which follow the slope of the surface to be drained, and a sloped trough 14 is unnecessary.

Grate frames 24, which are generally L-brace type or L-shaped structures, are attached to the upper surface of the flanges 18 such that the horizontal surface or foot of the L of the grate frame 24 is screwed or bolted onto the flange 18 and the vertical surface or spine of the L of the grate frame 24 extends vertically upward from the flange 18. The interiors of the grate frame 24 (that is, the interior of the L) face inward toward the channel 12 when mounted in the correct position. The vertical surface or spine of the L of a first grate frame 24 attached to the first of the pair of sidewalls 16 is substantially parallel to the vertical surface or spine of the L of a second grate frame 24 attached to the second of the pair of sidewalls 16 when the trench drain system 10 is installed. In this manner, the interior surface of the L of each grate frame 24 provides a seat on which one edge of the grating 32 may be placed, with the interior surface of each grate frame 24 supporting the one edge of the grating 32, while the pair of grate frames 24 attached to the pair of sidewalls 16 act in concert to form a seat which can support the entire grating 32. The grate frames 24 generally are supplied in six foot (6') or eighteen foot (18') lengths. When eighteen foot (18')

lengths are used, three (3) six foot (6') channels are screwed or bolted onto each pair of eighteen foot (18') grate frames 24. As is obvious, the grate frames 24 may be supplied in any length.

Attached to the outer, vertical surface or spine of the L of the grate frame 24 are anchors 26. When the trench drain system 10 is installed, anchors 26 will become embedded in concrete poured between the channel 12 and the trench 35, as more fully described below. The anchors 26 may be of any suitable shape and size, but must not extend above the top of the grate frame 24 as the top of the grate frame 24 generally is flush with the surface to be drained. Although the number of anchors 26 attached to the grate frame 24 may vary, it has been determined that one anchor approximately every eighteen inches (18") is sufficient to hold the trench drain system in place.

The installation of the trench drain system 10 is a simple, straightforward procedure. A trench 35 is dug into the surface to be drained 34. This trench 35 should be of a depth sufficient to accommodate the depth of the various channels 12 selected for the individual site plus an additional amount to allow the concrete 36 to be placed under the trench drain system 10. A wooden framework 38, comprising vertical supports 42, horizontal supports 44, and cross-supports 46 is erected within the trench 35. The purpose of the framework 38 is to allow one to suspend the trench drain system 10 within the trench 35 at the appropriate and proper height such that concrete 36 may be poured between the trench drain system 10 and the wall of the trench 35.

Figure 2:
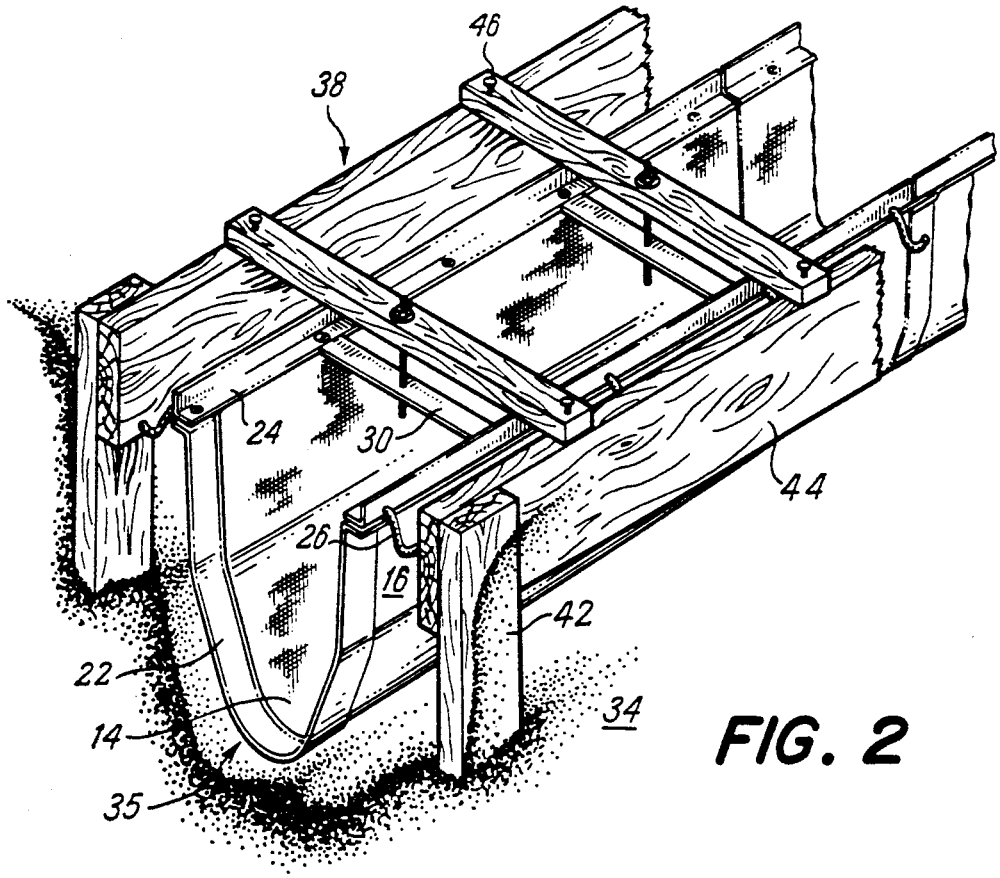
FIG. 2 is perspective view of the present invention suspended in a trench from a wooden frame work.

Referring now to FIG. 2 which shows the wood frame 38 supporting the trench drain system 10 in a typical trench 35, the horizontal supports 44 are supported by the vertical supports 42 such that the horizontal supports 44 are generally parallel to the surface to be drained. Cross-supports 46 extend between the parallel horizontal supports located on either side of the trench 35. Spacer bars 30 are located at suitable distances along the trench drain system 10 and extend from the first grate frame 24 on the first of the pair of sidewalls 16 on the first side of the channel 12 to a second grate frame 24 on the second of the pair of sidewalls 16 on the second side of the channel 12. Spacer bars 30 serve a dual purpose. First, spacer bars 30 hold the mouth or top opening 48 of the channel 12 at a desired width, generally of such a width such that sidewalls 16 are parallel to each other. Second, spacer bars 30 serve to allow the trench drain system 10 to be suspended from the wood frame 38 during installation procedures.

The trench drain system 10 should be suspended from the wood frame 38 such that the top edge of the grate frames 24 will be flush with the surface to be drained. As each successive channel 12 is suspended from the wood frame 38, the male connector 20 of the successive channel 12 is inserted into the female connector 22 of the previous channel 12, thus forming a continuous trough 14 in the trench drain system 10. As shown in FIG. 1, the preferred method of connecting successive channels is to have lap joints, previously described, between the grate frame 24 and the male connector 20 and female connector 22 of successive channels 12. With such lap joints, a bolt or screw 28 to hold the successive channels 12 together can be inserted first through a hole in grate frame 24, then through a hole in the male connector 20 of a first channel 12, then through a cooperating hole in the female connector 22 of the successive channel 12.

As each successive channel 12 is suspended from the wood frame 38, it is important that the direction of flow of the water will be from the female connector 22 end toward the male connector 20 end of each channel 12. That is, the water flow should be out from a first channel 12 through the male connector 20 in to a second channel 12 through the female connector 22. When the channels 12 are laid down in this fashion, the opportunity for leakage between successive channels 12 is minimized as the water flowing through the trench drain system 10 will not have the tendency to force itself between the outer surface of the male connector 20 and the inner surface of the female connector 22. Optionally, caulking or other sealant may be inserted between the male connector 20 and the female connector 22 to provide a better or water tight seal.

When the trench drain system 10 is suspended from the wood frame 38, concrete 36 is poured between the outer surface of the channels 12 and the trench 35. Sufficient concrete 36 is poured so as to surround completely the trench drain system 10 between the sidewalls 16 and trough 14 and the trench 35 and to be flush with the upper edge of the grate frame 24 and with the surface to be drained. In some installations, generally those utilizing channels 12 with high sidewalls 16, it may be necessary to brace the interior of the sidewalls of the channels 12 to prevent the concrete 36 from deforming the sidewalls 16 inwards. This bracing, if necessary, may be accomplished by any conventional means.

It also may be necessary to secure the cross support 46 to the wood frame 38 to prevent the channels 12 from floating upwards when the concrete 36 is poured in the trench 35. When the concrete 36 is flush with the surface to be drained and the upper edge of the grate frame 24, the anchors 26 are submerged in the concrete 36 and, when the concrete 36 dries, the anchors 26 will be embedded within the concrete 36, thus providing a permanent, solid connection keeping the trench drain system 10 in place.

Alternatively, support rods 40 may be attached to anchors 26 by conventional means, such as by wound wire. Rods 40 extend vertically downward from the anchors 26 and parallel to the sidewalls 16 within the dug out trench 35 area. Rods 40 then may extend a certain distance into the ground 34. When concrete 36 is poured within the trench 35 between the outside wall of the channels 12 and the trench 35, the rods 40 will support the channels 12 and prevent floating.

After the concrete 36 has dried and the wood frame 38 has been removed, grating 32 is placed over the mouth or top opening 48 of the channels 12 and is seated on the horizontal surfaces of the feet of the L of the grate frames 24, that is, within the interior of the grate frames 24 (that is, the interior of the L). A conventional, industry standard grating 32 may be used. The grating 32 should be of a size such that its thickness is equal to the height of the vertical sides of the grate frames 24, such that the top surface of the grating 32 also is flush with the surface to be drained, and the top edge of the grate frames 24, and of a width and length appropriate to the trench drain system 10 installed. With the grating 32 in place, the trench drain system 10 is complete. Water now may run off the surface to be drained, through the holes in the grating 32 and into the trench drain system 10. Due to the sloped nature of the troughs 14, or because the channels 12 are placed on a sloped surface to be drained, the water will run downhill through the trench drain system 10 through outlets (not shown). The outlets may be any type of outlet including side ports, bottom ports, end ports, and merely just emptying out into a sewer or other conduit.

It will be obvious to those skilled in the art that many variations may be made in the embodiment herein chosen for the purpose of illustrating the present invention, and for result may be had to the doctrine of equivalence without departing from the scope of the present invention as defined by the appended claims.

What is claimed is:

1. A forming system for in-ground formation of a trench drain for removing water from a surface comprising at least one channel, a plurality of grate frames, and a grating, said trench drain system being adapted to be supported in-ground by a supporting material formed beneath and outwardly about said drain system in conformity thereto, wherein:

said channel being a generally V-shaped component comprising a bottom wall integrally connected to a pair of opposing, spaced apart sidewalls, thus forming a trough, and a top opening opposite said bottom wall, said bottom wall and sidewalls defining a fluid carrying space and said top opening defining a fluid entrance, said sidewalls terminating in generally horizontal flanges extending outwardly from and perpendicular to said sidewalls directly above and resting on said supporting material;

each of said grate frames being a generally L-shaped component with a bottom horizontal surface of the L being secured to the upper surface of one said flange and a side vertical surface of the L disposed relatively outward from said fluid carrying space; and said grating being placed on and supported by the interior L surfaces of said grate frames for covering said top opening;

said grating being formed of a relatively strong material sufficient for support of above-ground loads on the surface against entrance into the trough, said channel being formed of a relatively lightweight thin-walled resin material for ease of handling but generally incapable of load-bearing support of said grating and above-ground loads placed thereon, said outwardly-extending disposition of said flanges locating said grate frames above the supporting material for load bearing support of said grating and loads placed thereon substantially entirely by the supporting material.

2. The trench drain as described in claim 1 wherein said channels further comprise male and female connector ends on opposite ends of said channels, said male and female connector ends adapted to be interlocked end-to-end, male connector to female connector, to provide a continuous channel of a predetermined length.

3. The trench drain as described in claim 2 wherein said bottom wall has a slope relative to the upper edge of said sidewalls so as to provide a gravity feed sloping drainage run.

4. The trench drain as described in claim 2 wherein said sidewalls are of variable and various heights.

5. The trench drain as described in claim 2 further comprising a grating to be placed over said top opening and between said grate frames.

6. The trench drain system as described in claim 2 further comprising support anchors integrally attached to said grate frames.

7. A forming system for in-ground formation of a trench drain for removing water from a surface comprising at least one channel, a plurality of grate frames, a plurality of support anchors integrally attached to said grate frames and a grating, said trench drain system being adapted to be supported in-ground by a supporting material formed beneath and outwardly about said drain system in conformity thereto, wherein:

said channel being a generally V-shaped component comprising a bottom wall integrally connected to a pair of opposing, spaced apart sidewalls, thus forming a trough and a top opening opposite said bottom wall, said bottom wall and sidewalls defining a fluid carrying space and said top opening defining a fluid entrance, said sidewalls terminating in generally horizontal flanges extending outwardly from and perpendicular to said sidewalls directly above and resting on said supporting material;

each of said grate frames being a generally L-shaped component with a bottom horizontal surface of the L being secured to the upper surface of one said flange and the side vertical surface of the L disposed relatively outwardly from said fluid carrying space;

said support anchors being integrally attached to the outside neutral surfaces of the L;

said grating being placed on and support by the interior L surfaces of said grate frame for covering said top opening; and said grating being formed of a relatively strong material sufficient for support of above-ground loads on the surface against entrance into the trough, said channel being formed of a relatively lightweight thin-walled resin material for ease of handling but generally incapable of load-bearing support of said grating and above-ground loads placed thereon, said outwardly-extending disposition of said flanges locating said grate frames above the supporting material for load bearing support of said grating and loads placed thereon substantially entirely by the supporting material.

8. The trench drain as described in claim 7 wherein said bottom wall has a slope providing a gravity fed channel for the disposal of water in the trough and said sidewalls being of various and variable heights such that as said trough slopes downward, said sidewalls remain parallel with and flush to the surface to be drained.

9. The trench drain as described in claim 8, further comprising a spacer bar located between anchors attached to opposite flanges of said channel, wherein said spacer bars provide for the proper spacing of said liquid opening.

10. The trench drain system as described in claim 3 or 8 wherein said channel is formed from a fibrous reinforced material impregnated with a thermoset resin.

11. The trench drain system as described in claim 10 wherein said fibrous reinforcing material is a fiberglass.

12. The trench drain system as described in claim 10 wherein said thermoset resin is selected from the group consisting of polyester, vinyl ester, epoxy and acrylic.

13. A forming system for in-ground formation of a trench drain for removing water from a surface comprising at least one channel, a plurality of frame members, and a plurality of support anchors integrally attached to said frame members, said trench drain system being adapted to be supported in-ground by a supporting material formed beneath and outwardly about said drain system in conformity thereto, wherein:

said channel being a generally V-shaped component comprising a bottom wall integrally connected to a pair of opposing, spaced apart sidewalls, thus forming a trough, and a top opening opposite said bottom wall, said bottom wall and sidewalls defining a fluid carrying space and said top opening defining a fluid entrance, said sidewalls terminating in generally horizontal flanges extending outwardly from and perpendicular to said sidewalls directly above and resting on said supporting material; and each of said frame members having a horizontal portion secured to the upper surface of one said flange;

said support anchors being integrally attached to said horizontal portion for securement to the supporting material;

said channel being formed of a relatively lightweight thin-walled resin material for ease of handling but generally incapable of load-bearing support of above-ground loads placed on said frame members, said outwardly-extending disposition of said flanges locating said frame members above the supporting material for load bearing support of loads placed thereon substantially entirely by the supporting material.

* * * * *